United States Patent [19]

Rowman

[11] 4,066,264

[45] Jan. 3, 1978

[54] DRUM HALTING SYSTEM FOR GAME APPARATUS

[76] Inventor: Philip J. Rowman, Derry Road, Hudson, N.H. 03051

[21] Appl. No.: 604,593

[22] Filed: Aug. 14, 1975

[51] Int. Cl.[2] ..... A63F 5/04

[52] U.S. Cl. ..... 273/143 R; 74/501 R

[58] Field of Search ..... 273/143 R, 143 A, 143 B, 273/143 C, 143 D, 143 E, 142 H, 142 HA; 74/501 R, 502

[56] References Cited

U.S. PATENT DOCUMENTS

| | | | |
|---|---|---|---|
| 20,075 | 4/1858 | Liebrich | 273/143 R |
| 518,316 | 4/1894 | Grove | 273/143 R |
| 3,870,313 | 3/1975 | Rowman | 273/143 C |

FOREIGN PATENT DOCUMENTS

| | | | |
|---|---|---|---|
| 337,895 | 3/1904 | France | 273/143 E |
| 3,953 | 2/1905 | France | 273/143 D |
| 1,075,480 | 2/1960 | Germany | 273/143 R |
| 644,818 | 10/1950 | United Kingdom | 273/143 R |
| 194,020 | 3/1923 | United Kingdom | 273/142 JB |
| 391,500 | 5/1933 | United Kingdom | 273/142 JB |

*Primary Examiner*—William H. Grieb
*Assistant Examiner*—Arnold W. Kramer
*Attorney, Agent, or Firm*—Pearson & Pearson

[57] ABSTRACT

A housing encloses at least two heavy numeral-carrying drums, visible through a window, the drums rotating in horizontal planes on a vertical axis. Control mechanism, exterior of the housing, is arranged to advance acute-angled, detent halting members within the housing, in a rectilinear path radial to the drums, to enter one of a plurality of obtuse-angled teeth in juxtaposed thin wafer like annular ring gears on the drums to simultaneously halt all of the drums, with the numerals in the window. Each halting member is associated with the ring gears of two adjacent drums. A common yoke actuated by an elongated, push button, Bowden wire connection simultaneously actuates all the halting members. Similar exterior control means may be used to initiate the rotation of the drums within the housing.

1 Claim, 8 Drawing Figures

DRUM HALTING SYSTEM FOR GAME APPARATUS

BACKGROUND OF THE INVENTION

Drums rotating within a housing and having indicia such as numerals on the circumferential surfaces thereof, visible through a window have long been mounted on horizontal axes and used in games of skill and chance. For example in U.S. Pat. No. 756,514 to Maxwell of Apr. 5, 1904, three such drums are disclosed as is push control mechanism for locking one drum against rotation while the others continue to be rotatable by means of projecting pins on the drums.

Magnets have been used to slow the rotation of drums in U.S. Pat. No. 2,775,458 to Raymond of 1956. Weights falling into sockets are used for a similar purpose in U.S. Pat. No. 2,121,494 to Babcock of 1938. Pauls engaging in the teeth of ratchet gears are proposed in U.S. Pat. No. 2,152,599 to Mills of 1939.

However none of the above expedients have been found to be satisfactory for halting simultaneously the very sensitive and accurate rotation of heavy drums, rotatable in horizontal planes in opposite directions on a vertical axis within a heavy housing suitable for tamperproof games of skill and chance.

SUMMARY OF THE INVENTION

In this invention drums rotating on a horizontal axis are not used because it has been found virtually impossible to prevent the drums from rapidly tending to always stop with the same numerals in the window of the housing.

Therefore an upstanding vertical housing of thick walled metal is provided with a vertical open window and a vertical shaft upon which one or more and preferably three relatively heavy cylindrical drums are journalled to rotate in horizontal planes. One drum does not rest on a lower drum and thereby fail to rotate independently. The drums of this invention are separated by spacers or the shaft is stepped to provide independent rotation in either direction and a predetermined clearance between drums.

In the one embodiment a wedge of nylon or other polymeric meterial is slidable in an aperture in the housing wall opposite each such clearance, poised to advance thereinto to frictionally engage the adjacent diametrical surfaces to simultaneously halt all of the drums. A push button Bowden wire connection, fully visible to preserve an honest image, is operableoutside the housing to actuate the wedges, and preferably the wedges are on opposite sides of the shaft to avoid distortion thereof.

Vertical magnets in the wall of the housing are positioned to attract the magnetizable metal of the drums and turn the drums to exactly frame indicia thereon in the window, after the drums have been halted by the braking mechanism.

In the preferred embodiment of the invention wherein the three drums are rotated in opposite directions, the adjacent diametrical surfaces of the middle drum with the upper and lower drums each have a thin ring gear, with obtuse angled teeth, affixed thereto. A pair of detents, each having an acute angle, wedge-shaped face, are simultaneously moved by a flexible wire control exterior of the housing within the housing, in a rectilinear path, radial to the drums, to wedge into the wide, angular teeth on the ring gears to instantly halt the drums. Magnets are preferred but not necessary in this embodiment. By affixing smaller diameter rings with peripheral gear teeth nearer to the centre of the drums, a similar flexible wire actuator is used to bias a gear rack activator so that return springs may rotate the drums.

In still another embodiment a simulated dice housing is provided which may be suspended from the ceiling above a game table, the housing having eight faces, each alternate face having a numeral viewing window. The housing contains two drums, each with multiple curved faces marked in the manner of a die, so that when turned, a face of each drum will appear in the upper and lower part of the window of each alternate face to indicate the same dice throw in four quadrants. The two drums are actuated and halted by flexible wire actuators, passed from one player to the next, the player first rotating the drums and then halting them simultaneously.

DESCRIPTION OF A PREFERRED EMBODIMENT

Figure 2:
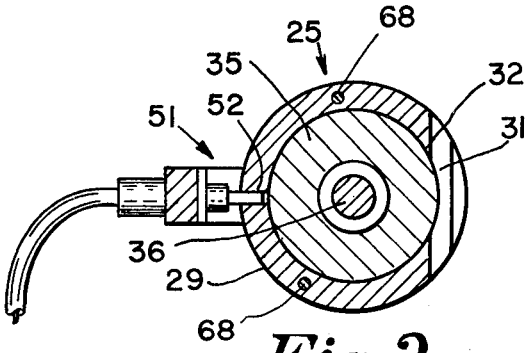
FIG. 2 is a top plan view in section on line 2—2 of FIG. 1.

As shown in the drawings, the apparatus 25 of the invention, in in one embodiment, includes a vertically extending, upstanding housing 26 of heavy metal which may be supported on a suitable stand 27 with a base 28. Housing 26 generally is cylindrical with a thick wall 29, having a vertically extending open window 31 in a flattened chordal face 32. At least two hollow cylindrical drums 33 and preferably three such drums 33, 34 and 35 are freely rotatable in horizontal planes on the vertical axis of a shaft 36 having its upper end 37 seated in a recess 38 in top wall 39 and its lower end 41 seated in a recess 42 in the threadedly removable bottom closure 43.

The drums 33, 34 and 35 are hollow and generally cylindrical with cylindrical surfaces such as 44 upon which indicia such as numerals 45 are carried. The drums rotate in circular paths usually by pressure of the fingers in the open window and are freely rotatable independently of each other by means of suitable ball bearings. Annular spacers may be provided between the adjacent diametrical surfaces 46 of the drums, each spacer supported on a transverse pin through the shaft or preferably the shaft 36 includes three steps 47, 48 and 49, each of progressively greater diameter for supporting the drums.

When turned by the fingers of the operator the drums 33, 34 and 35 which are of heavy material achieve considerable momentum and considerable delay occurs before certain of the numerals 45 on each drum come to a gradual halt in the window 31.

Figure 3:
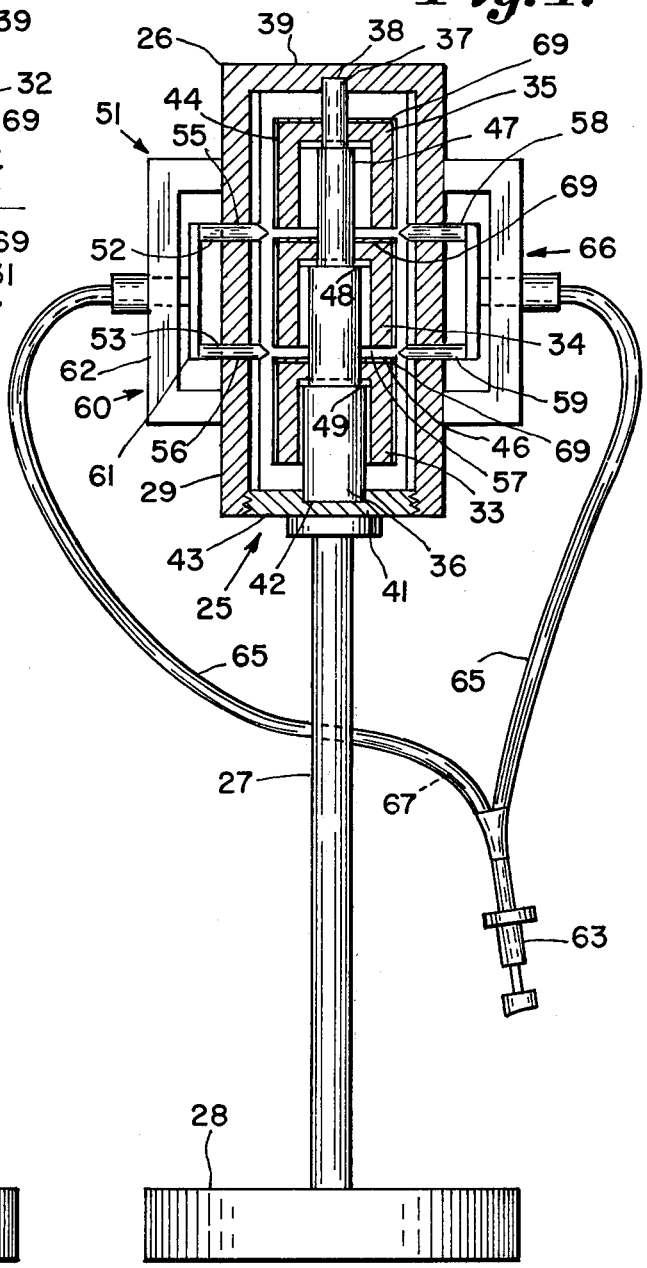
FIG. 3 is a front elevational veiw similar to FIG. 1, of another embodiment and showing opposed wedges.

Drum halting means 51 is therefore provided comprising at least one wedge-shaped element 52 or 53 formed of polymeric material 54, such as nylon, and slidable in apertures 55 or 56 in wall 29 from a retracted position, slidably in a rectilinear path, radial to the drums to an advanced position in frictional engagement with the diametrical surfaces 46 of the drums, in the predetermined clearance 57 therebetween. As shown in FIG. 3, preferably a set of wedges 58 and 59 are mounted opposite the wedges 52 and 53 to counteract any tendency to distort the shaft or drums by counterbalancing the wedging pressure.

The wedges 52 and 53 are actuated by control mechanism 60 comprising a common support bar, or yoke, 61 slidable in a bracket 62, the bar 61 being movable by a camera shutter type push button 63, Bowden wire 64 and tube 65. Similar mechanism 66 on the other side of the housing is connected by a Bowden wire 67 to cause the oppositely disposed wedges to move in unison. The control mechanism is fully visible in that when the button is pressed the bar 61 may be seen to move the wedges to simultaneously halt all of the drums.

Vertically extending magnets 68 are spaced around wall 29 and magnetizable elements 69 are carried by drums 33 and 34 and 35 so that when the braking means has been actuated and released the drums automatically turn slightly to exactly frame the numerals in the window.

Figure 4:
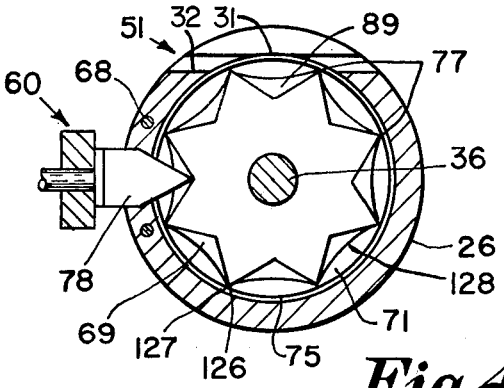
FIG. 4 is a top plan view of a preferred embodiment, in section on line 4—4 of FIG. 5 and showing simultaneous halting by teeth and detents.
Figure 1:
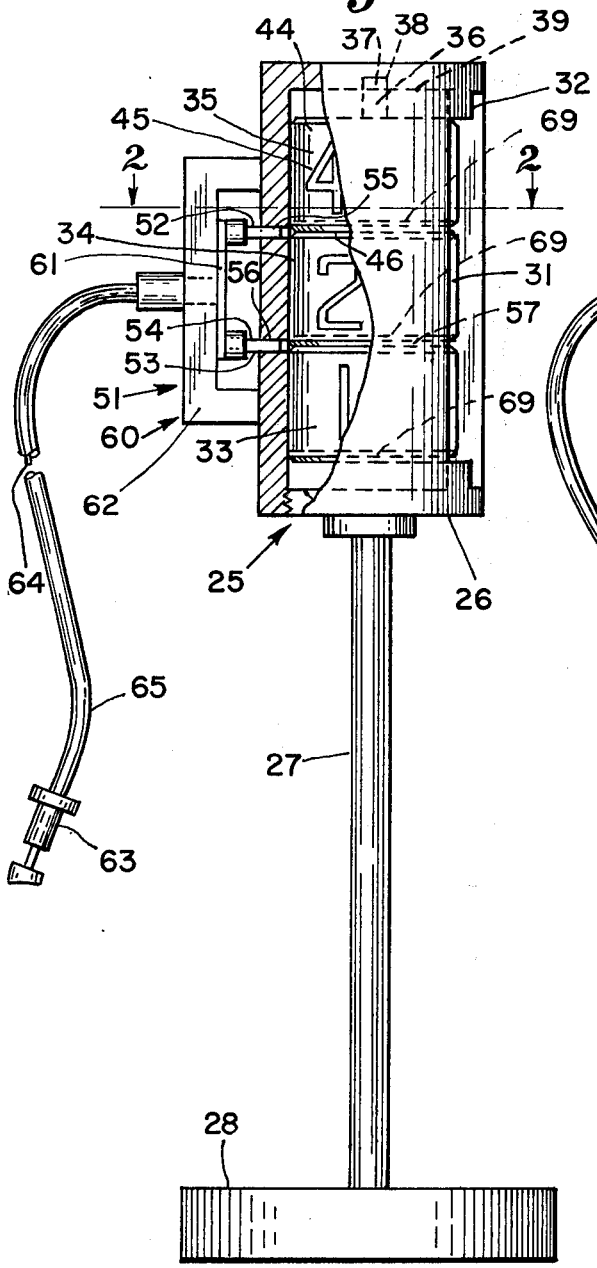
FIG. 1 is a side elevational view of one embodiment of the apparatus of the invention, wherein the halting is simultaneous by friction.
Figure 5:
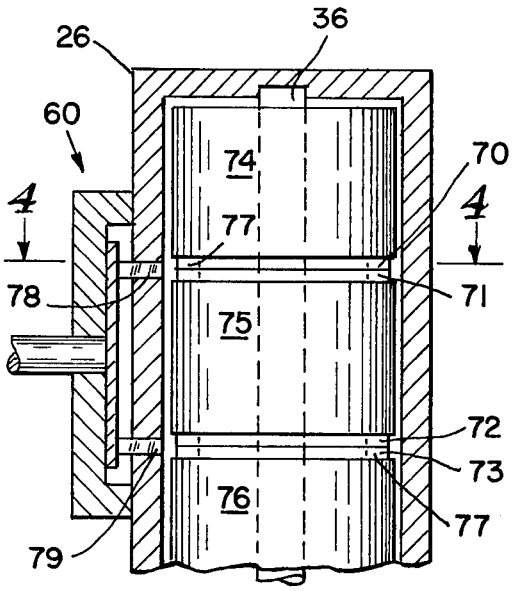
FIG. 5 is a fragmentary side elevation in half section of the device shown in FIG. 4.

As shown in FIGS. 4 and 5, the drum-halting means 51 may be more positive, and consist in at least two thin waferlike, annular ring gears such as 70 and 71 and 72 and 73 affixed to the adjacent diametrical faces of the drums 74, 75 and 76. A plurality of obtuse angled teeth 77 extend peripherally around each ring, one tooth for each indicia for engagement by the acute angled, wedge-like detents 78, and 79, so that actuation of the control mechanism 60, or 66, causes the acute angled detents to slide in a rectilinear path radial to the drums to enter obtuse angled spaces between obtuse angled teeth 77 in the drums simultaneously. The teeth 77 are so arranged that the numerals will be framed in the windows when the drums are halted. Thus the magnets 68 and elements 69 are not essential for halting in this embodiment, but are useful upon retraction of the detents to retain the numerals in the window.

Figure 6:
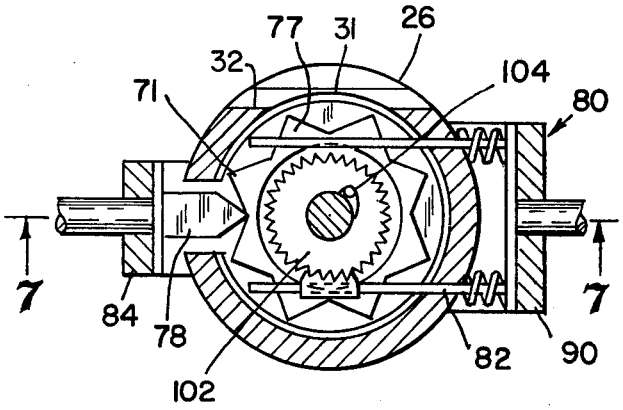
FIG. 6 is a view similar to FIG. 4 showing the halting mechanism supplemented by similar mechanism for initially turning the drums.
Figure 7:
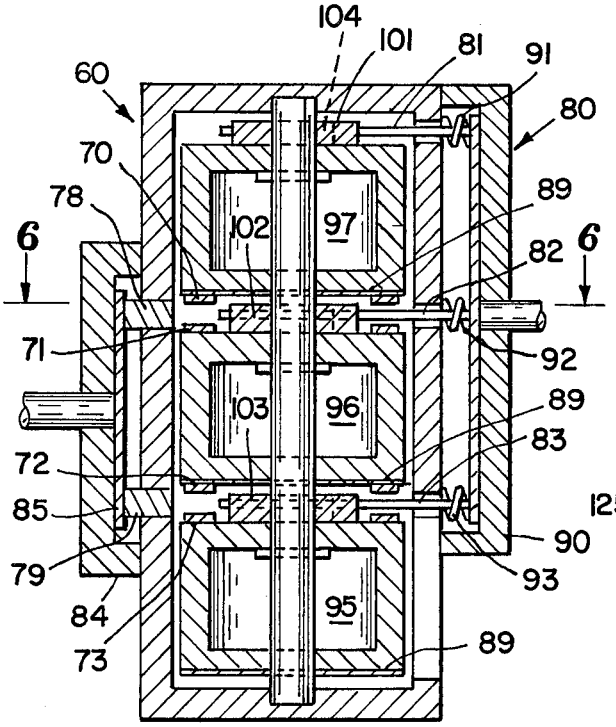
FIG. 7 is a view similar to FIG. 5 in section on line 7—7 of FIG. 6.

As shown in FIGS. 6 and 7 a drive mechanism 80, similar to mechanism 60 or 66 with its flexible wire actuating mechanism can be adapted to either rotate all of the drums, simultaneously by gear rack elements 81, 82 and 83, or to spring bias such elements, so that the springs 91, 92 and 93 rotate the drums.

The bracket 84 contains the pair of acute angled, detents 78 and 79 movable by yoke 85 to halt the obtuse angled, toothed rings 70, 71, 72 and 73 simultaneously. A bracket 90 contains the three toothed gear racks 81, 82 and 83 spring biased by springs 91, 92 and 93, to rotate the three drums 95. 96 and 97 simultaneously. The gear racks 81, 82 and 83 are arranged to tangentially engage the small diameter annular toothed gears 101, 102 and 103 affixed to their respective drums by unidirectional clutches such as 104.

Figure 8:
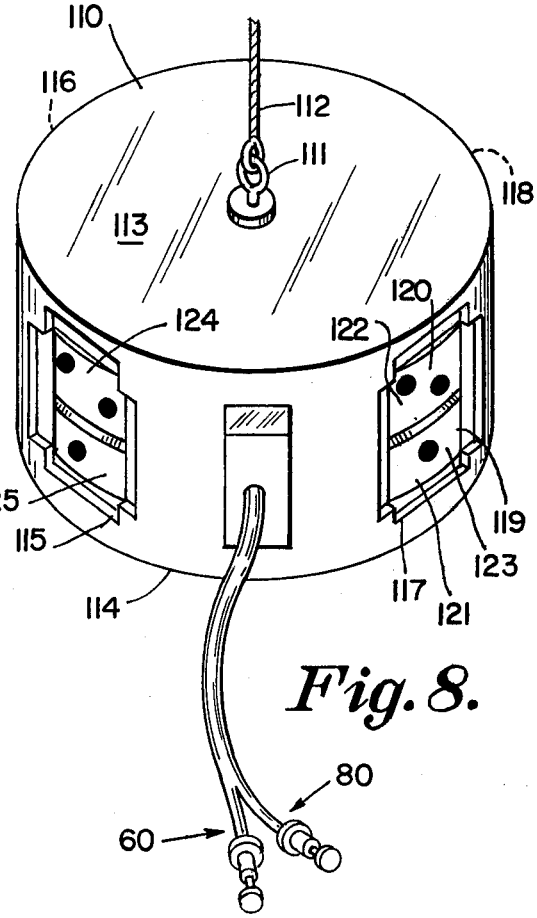
FIG. 8 is a perspective view of still another embodiment of the invention wherein the housing depends from the ceiling.

As shown in FIG. 8 another embodiment of the invention comprises a cylindrical housing 110 which may be on a post 27, or may depend from a ceiling by the eye 111 and cord 112 and having a top face 113, bottom face 114 and four arcuate side faces such as at 115, 116, 117 and 118. Each side face has a window such as 119 with an upper portion 120 and a lower portion 121 in which a face 122 or 123 of one of the two drums 124 and 125 appears. The faces 122 and 123 carry the six sided markings of a pair of dice totalling twenty four such faces so that the same digits will appear in each of the four quadrants to persons gathered around a game table. The drums 124 and 125 may be finger rotated but preferably each successive player is handed a flexible control, such as at 80 in FIGS. 6 and 7, to first rotate the drums simultaneously and then positively halt the two drums simultaneously.

If numerals are to be used on the drums 124 and 125, there are four sets of ten numerals, one set for each quadrantal window of the housing totalling forty numerals.

Since the drums are preferably of aluminum and the ring gears 70, 71, 72 and 73 are preferably of "Teflon", or Nylon, a thin, wafer like ring 89 of magnetizable metal, of identical configuration is bonded to each ring 70, 71, 72 and 73 to be attracted by magnets 68.

The magnetizable elements 69 in the form of the thin wafers 89, are of HY MU 80 a commercially available magnetizable material and about 0.007 inches thick with an undulated, or flower-like, periphery 126. Each radially outward portion 127 of the periphery 126 is positioned to be attracted by a magnet 68 to halt the drum with the indicia in each window, the radially inward spaces 128 between the portions 127, not being close enough to the magnets to be attracted thereby.

In place of the camera shutter, flexible spring, or Bowden wire control devices 63, 64 and 65 of the actuating mechanisms 60, 66 or 80. I may use a flexible bulb, air tube piston and cylinder type control which is also well known as a camera shutter control.

It should be noted that unlike the spring actuated halting mechanism of the prior art, in this invention the drums are free to rotate, when the slight magnetic forces are overcome, by use of the fingers or by gear rack or pneumatic bulb mechanism. The drums are thus normally freely rotatable and only halted when the control mechanism is actuated to advance the detents into the teeth of the ring gears.

I claim:

1. In a game apparatus of the type having a housing with a window in the wall thereof and at least two numeral carrying drums rotatable in horizontal planes on a fixed vertical axis within said housing for displaying numerals in said window the combination of:

drum halting means for simultaneously halting all of said drums, without waiting for inertia to halt the same, said means comprising juxtaposed, obtuse angled teeth on adjacent said drums and a plurality of halting detents each movable within said housing into engagement with the juxtaposed teeth of each two adjacent said drums to halt the same simultaneously, and control mechanism extending from said halting detents to outside said housing, and operable from outside said housing to actuate said halting detents, said control mechanism including a common yoke on the exterior of said housing from which said detents extend through the wall of said housing into the interior thereof, and an elongated, push button, Bowden wire connection for actuating said common yoke, whereby said control mechanism is visible and simple to present a tamper-proof appearance.

* * * * *